United States Patent [19]

Slaton

[11] 4,043,723

[45] Aug. 23, 1977

[54] CONDUIT MOLDING MACHINE

[76] Inventor: Stewart E. Slaton, 2841 NE. 22nd Ave., Lighthouse Point, Pompano Beach, Fla. 33064

[21] Appl. No.: 672,998

[22] Filed: Apr. 2, 1976

[51] Int. Cl.[2] ..... B28B 7/18; B28B 21/42

[52] U.S. Cl. ..... 425/186; 249/64; 425/218; 425/427; 425/454; 425/457; 425/468

[58] Field of Search ..... 425/218, 262, 427, 457, 425/460, 468, 469, 454, 186; 249/64

[56] References Cited

U.S. PATENT DOCUMENTS

| | | | |
|---|---|---|---|
| 1,514,980 | 11/1924 | Mathis | 425/468 |
| 3,009,229 | 11/1961 | Tumey | 425/442 |
| 3,642,419 | 2/1972 | Toksvig | 425/457 |
| 3,775,529 | 11/1973 | Steenson et al. | 425/218 |
| 3,829,265 | 8/1974 | Holm | 425/468 |
| 3,836,312 | 9/1974 | Derror | 425/454 |

FOREIGN PATENT DOCUMENTS

| | | | |
|---|---|---|---|
| 335,903 | 4/1921 | Germany | 425/468 |

*Primary Examiner*—Francis S. Husar
*Assistant Examiner*—John McQuade
*Attorney, Agent, or Firm*—Harry N. Schofer

[57] ABSTRACT

A molding machine adapted to selectively mold conduits having rows of ducts in one or more tiers. Means are provided, in a carriage section, to selectively connect and disconnect any of a plurality of mandrels adapted to reciprocate with the carriage to vary the number of tiers to be molded, while a platform in a mold receiving section can be selectively raised to a number of positions to cooperate with the selected mandrels.

10 Claims, 20 Drawing Figures

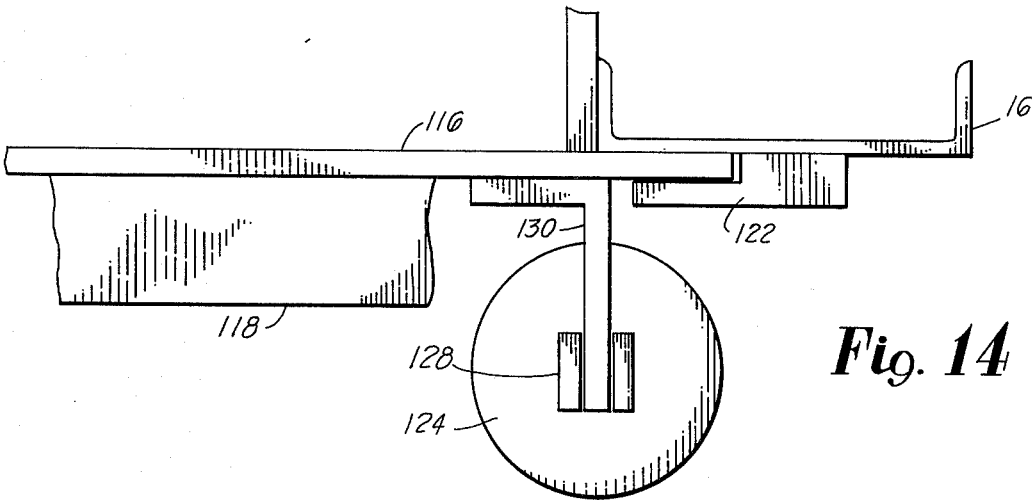
Fig. 14
Fig. 13
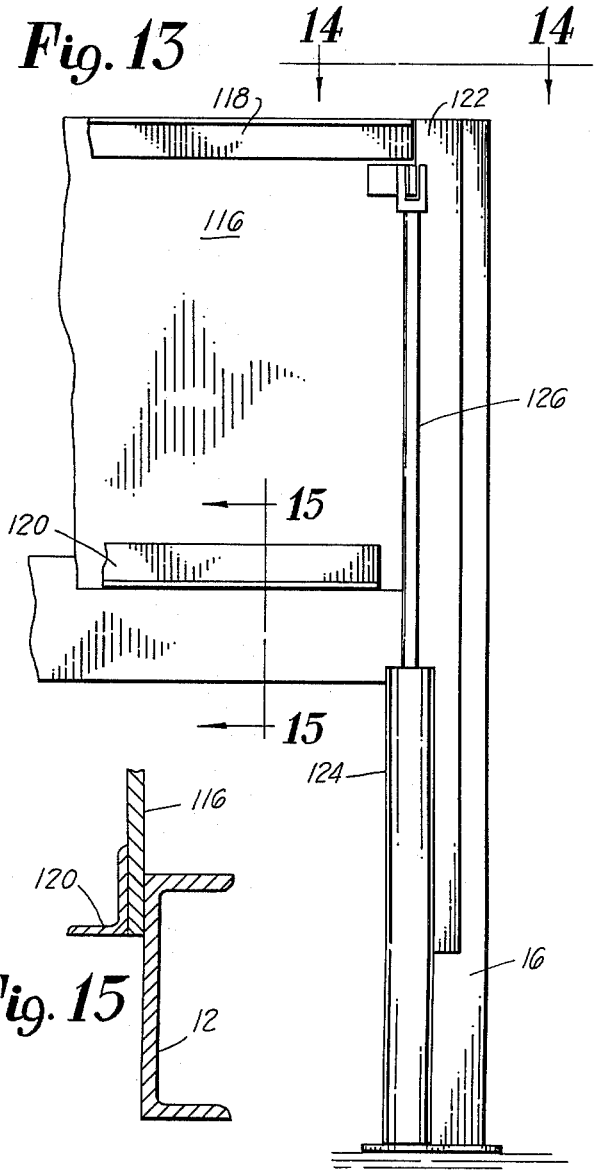
Fig. 15
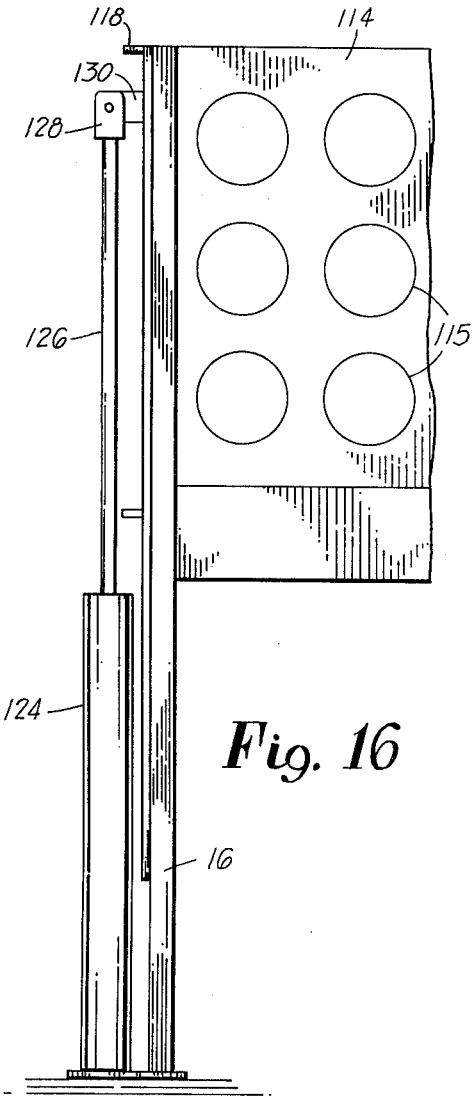
Fig. 16

CONDUIT MOLDING MACHINE

BACKGROUND OF THE INVENTION

Field of the Invention

This invention relates to a molding machine, and more particularly to a conduit forming molding machines selectively adaptable to simultaneously form rows of ducts in one, two or more tiers.

The invention relates particularly to the molding of concrete conduits formed to be laid in sections, each section having one or more rows of ducts, one row being formed above another row in tiers. Conduits of this type are molded in sections which may be 10 or more feet in length, each section having end joints whereby one section may be joined, in the field in situ, to an adjacent section to form a continuous conduit system. Conduit systems of this type are buried underground, and are adapted to receive electric power and telephone cables. Most of such conduits have three ducts uniformly spaced in each row, and the rows may be formed in a single row or tier, or in two or three or more tiers, usually referred to as a three duct, six duct, or a nine duct conduit, etc.

While the disclosure appearing below described a molding machine capable of forming one, two or three tiers in a conduit, with three ducts in each tier, it should be understood that such numbers are used only in describing a preferred embodiment, and that more than three tiers, and that more or fewer than three ducts may be molded in each row.

SUMMARY OF THE INVENTION

It is an object of this invention to provide a novel molding machine which can quickly and easily be set to mold conduits having ducts disposed in one or more tiers.

It is a further object to provide a novel molding machine permitting easy loading and unloading of the forming molds.

It is a still further object to provide a novel conduit molding machine having a minimum number of parts, which is rugged, and is simple to construct, operate, and to service.

The attainment of the above objects as well as other objects and advantages is accomplished by a novel construction of a conduit molding machine in which an elongated supporting structure carries a transversely extending bulkhead separating a mandrel operating section and a mold receiving section. In the mandrel operating section, the upper part of the supporting structure carries tracks along which a mandrel carrying carriage reciprocates between the bulkhead and a transversely extending end platen to reciprocate and to rotate the mandrels, which are connected with the carriage, in position through a mold form in the mold receiving section. The mandrels pass through sleeves in the carriage, and means are provided whereby the mandrels may be selectively secured to either the rotating sleeves in the carriage or to fixed sleeves in the transversely extending end platen. A plurality of motors are mounted on one side of the carriage, each motor being connected with the sleeves in a horizontal row, to rotate the sleeves and the mandrels attached thereto.

The mold receiving section includes a plurality of rollers to facilitate movement of the pallet holding the mold, and a plurality of lifting plates are disposed between the rollers. Hydraulic jacks engage the lifting plates to raise and lower the pallet to selected levels to form conduits having one, two or three tiers.

A screed is movable over the top of the mold receiving section to form a smooth upper surface on the conduit being molded.

BRIEF DESCRIPTION OF THE DRAWINGS

For a clearer understanding of the invention and its operation, reference is made to the annexed drawings illustrating a preferred embodiment, in which:

FIG. 13 is a side view of one of the doors for the mold receiving section and its operating mechanism;

FIG. 14 illustrates the door and a guide therefor, as seen on the line 14—14 of FIG. 13;

FIG. 15 is a sectional view through the door as seen on the line 15—15 of FIG. 13;

FIG. 16 is an end view of the door and its operating mechanism;

DETAILED DESCRIPTION OF A PREFERRED EMBODIMENT

Figure 1:
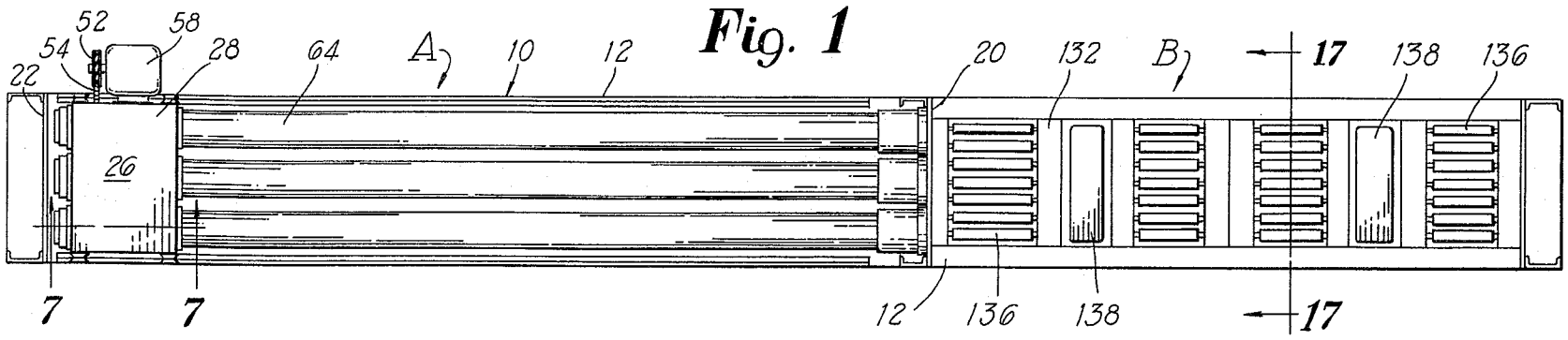
FIG. 1 is a top plan view of a preferred embodiment in which certain parts have been omitted to better illustrate other parts.

Referring to the annexed drawings illustrating a preferred embodiment, the numeral 10 designates the conduit molding machine in its entirety, comprising a supporting frame structure including a pair of longitudinally extending channels 12 supported by a pair of left hand end posts 14, a pair of right hand end posts 16, and a plurality of intermediate posts 18, the channels 12 being attached to the posts 14, 16 and 18 by any well known means, for example, by welding.

A vertically disposed bulkhead 20 extends transversely of the machine, forming a dividing means between a mandrel operating section A on the left hand side, and a mold receiving section B on the right hand side thereof.

Figure 4:
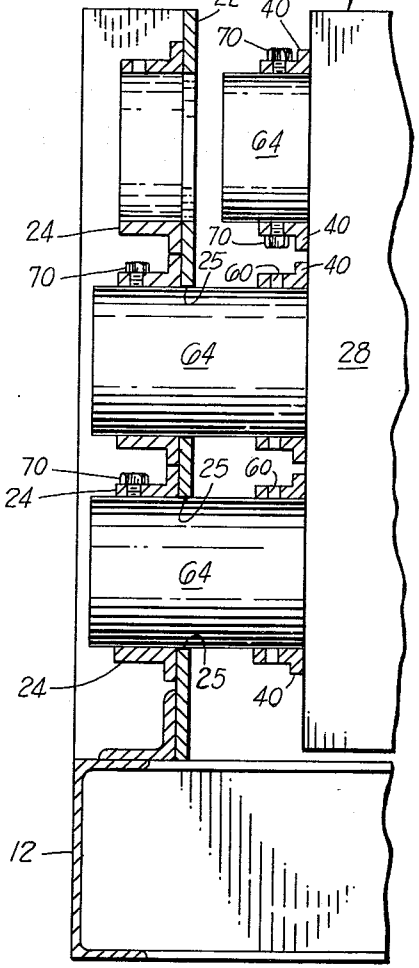
FIG. 4 is a sectional view taken on the line 4—4 of FIG. 3.
Figure 3:
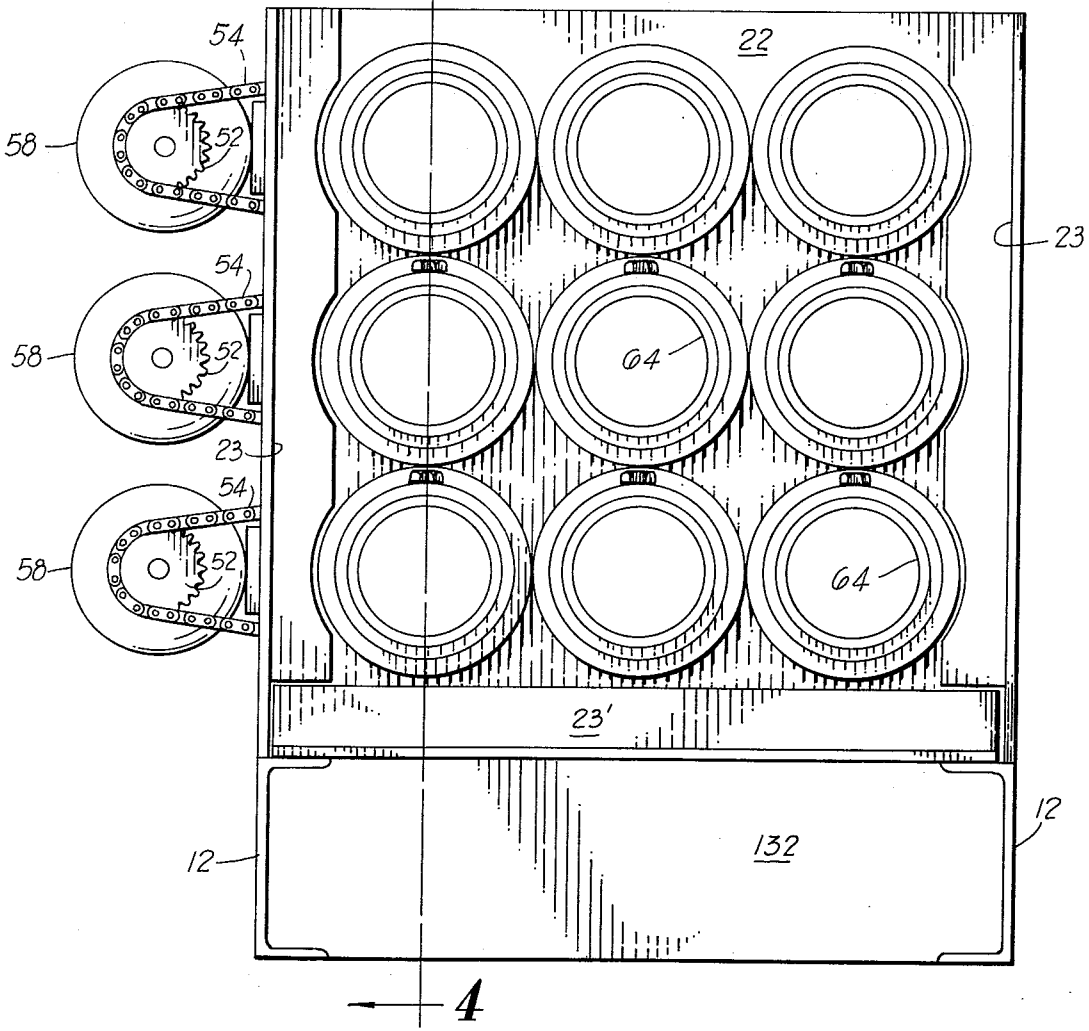
FIG. 3 is an end view as seen from the left hand end of FIG. 1.

A vertically disposed mandrel retaining end plate 22 is mounted on the left hand end of the machine, which plate, as shown in FIGS. 3 and 4, is welded to a pair of side angles 23 and a bottom angle 23', the latter being welded to the frame channels 12. The plate 22 is provided with nine openings 25 (FIG. 4), there being three openings in each horizontal row disposed in three tiers, the openings in each row being disposed directly above the openings in the row above or below. A sleeve 24 is disposed in alignment with each opening 25, the sleeves being fixed by welding to the plate 22.

Figure 2:
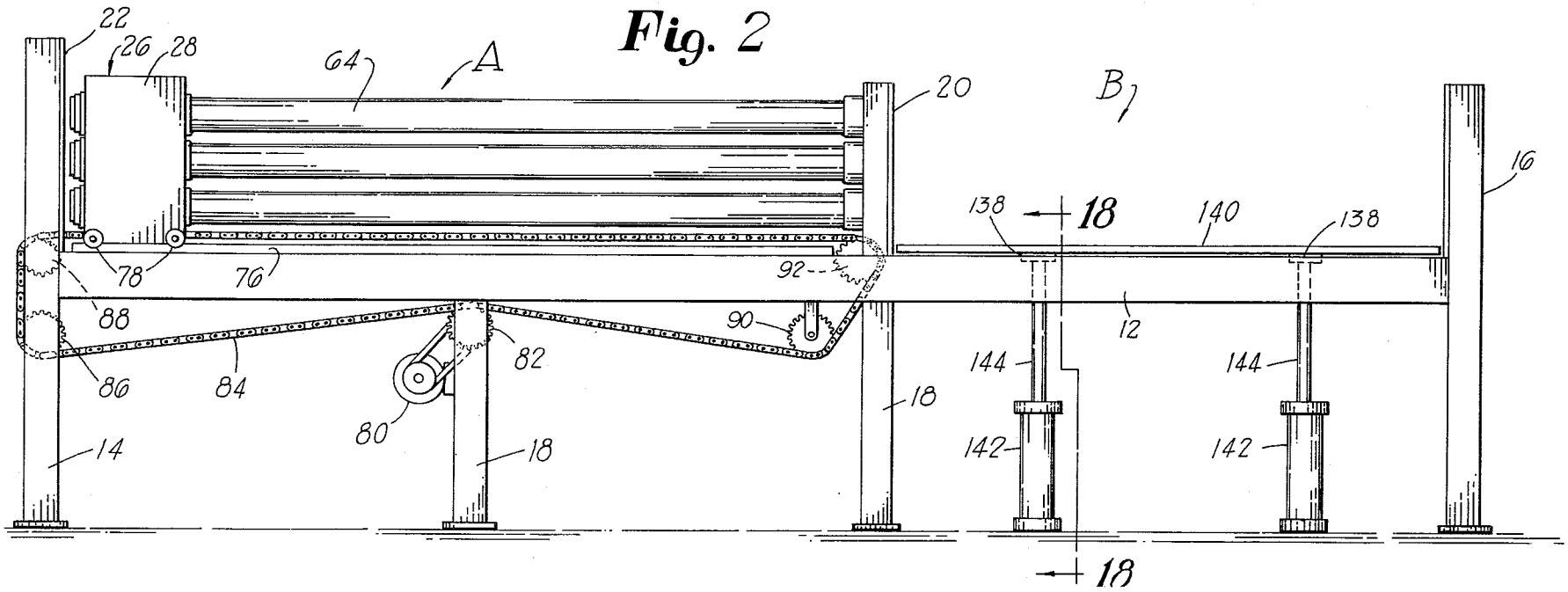
FIG. 2 is an elevation view of the embodiment shown in FIG. 1.
Figure 7:
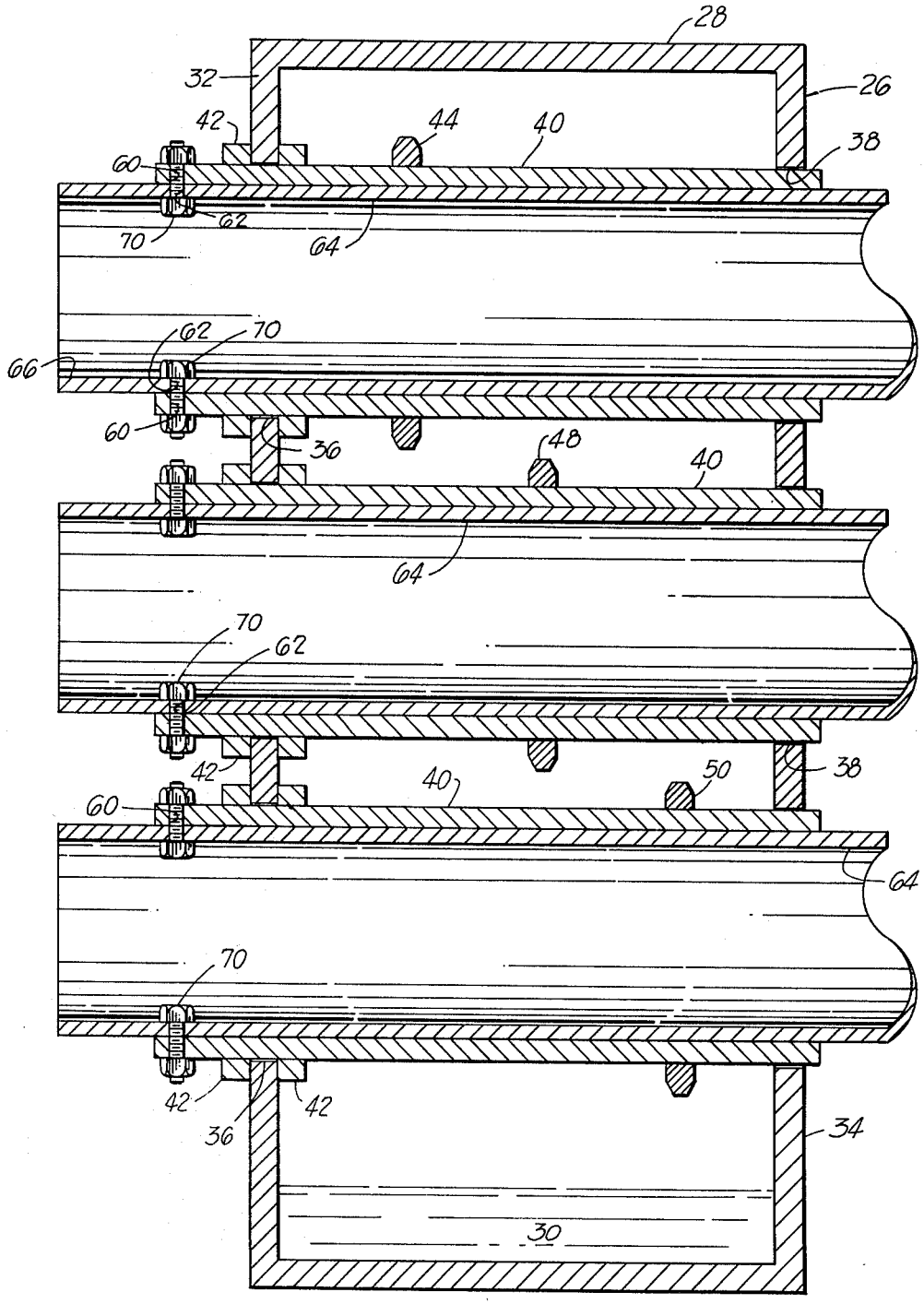
FIG. 7 is a sectional view through the carriage mechanism, taken on the line 7—7 of FIG. 1.
Figure 8:
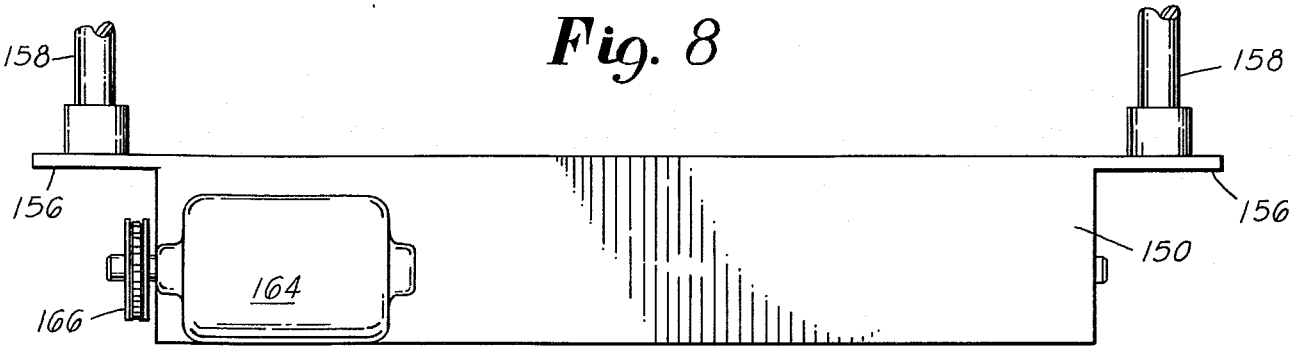
FIG. 8 is a top plan view of the screed assembly.
Figure 9:
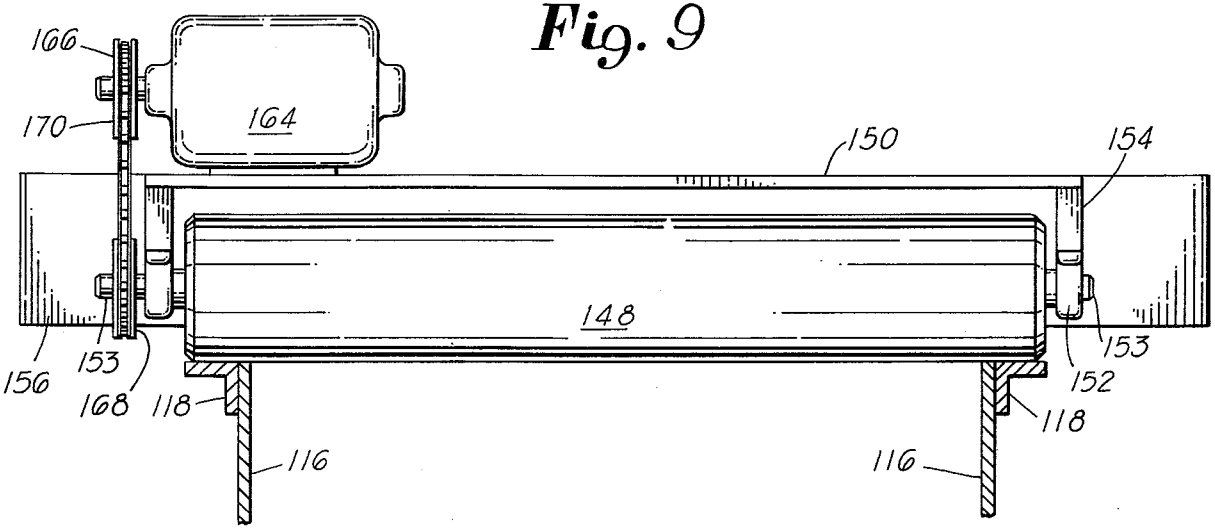
FIG. 9 is a side view of the screed assembly.

As shown in FIGS. 1 and 2, a carriage assembly 26 is mounted for movement between the end plate 22 and the bulkhead 20. The carriage assembly includes a closed housing 28 (FIG. 7) having an oil reservoir 30 in the bottom thereof, the oil being forced fed by means, not shown, and not forming a part of this invention, to the chains, sprockets and mandrel bearings. Each of the left hand and right hand walls 32 and 34 includes nine openings 36 and 38, respectively, the openings being aligned with the openings 25 in the end plate 22 for a purpose to be explained later in this description, each of the openings 36 and 38 forming a bearing for an elongated driving sleeve 40.

A pair of circular flanges or rings 42 is welded to the left hand end of each sleeve 40, the spacing between the flanges 42 being equal to the thickness of the left hand end wall 32, one flange being disposed on the outer side of the wall and the other flange disposed on the inner side of the wall, this arrangement preventing longitudinal movement of the sleeves but permitting rotation of the sleeves in an obvious manner.

A sprocket 44 is welded to the left hand end of each sleeve 40 in the top row or tier. A sprocket 48 is welded to the intermediate portion of each sleeve 40 in the second row or tier, and a sprocket 50 is welded to the right hand end of each sleeve 40 in the bottom row or tier. Three motors 58 are mounted on a side wall of the housing 28, one above the other and in line with the sprockets 44, 48 and 50 (FIG. 3), each motor having a sprocket 52 on the drive shaft thereof, the sprockets being connected by a chain drive 54 with the sprockets 44, 48, and 50 in each row, respectively, either directly or indirectly by intermediate sprocket and chain drives between one sleeve and and adjoining sleeve in the same row or tier.

An elongated mandrel 64 is mounted in each of the sleeves 40. Each of the mandrels is hollow, the left hand end being open, and the right hand end being closed and tapered in the form of a frustum of a cone. A plurality of apertures 60 extend through the left hand end of each of the sleeves 40 and the corresponding apertures 62 extend through the left hand end of each of the mandrels, permitting the connection of the mandrel 64 with the sleeve 40 by bolts and nuts 70 passing through the apertures, whereby the mandrels reciprocate and rotate with the corresponding movement of the sleeve.

Figure 20:
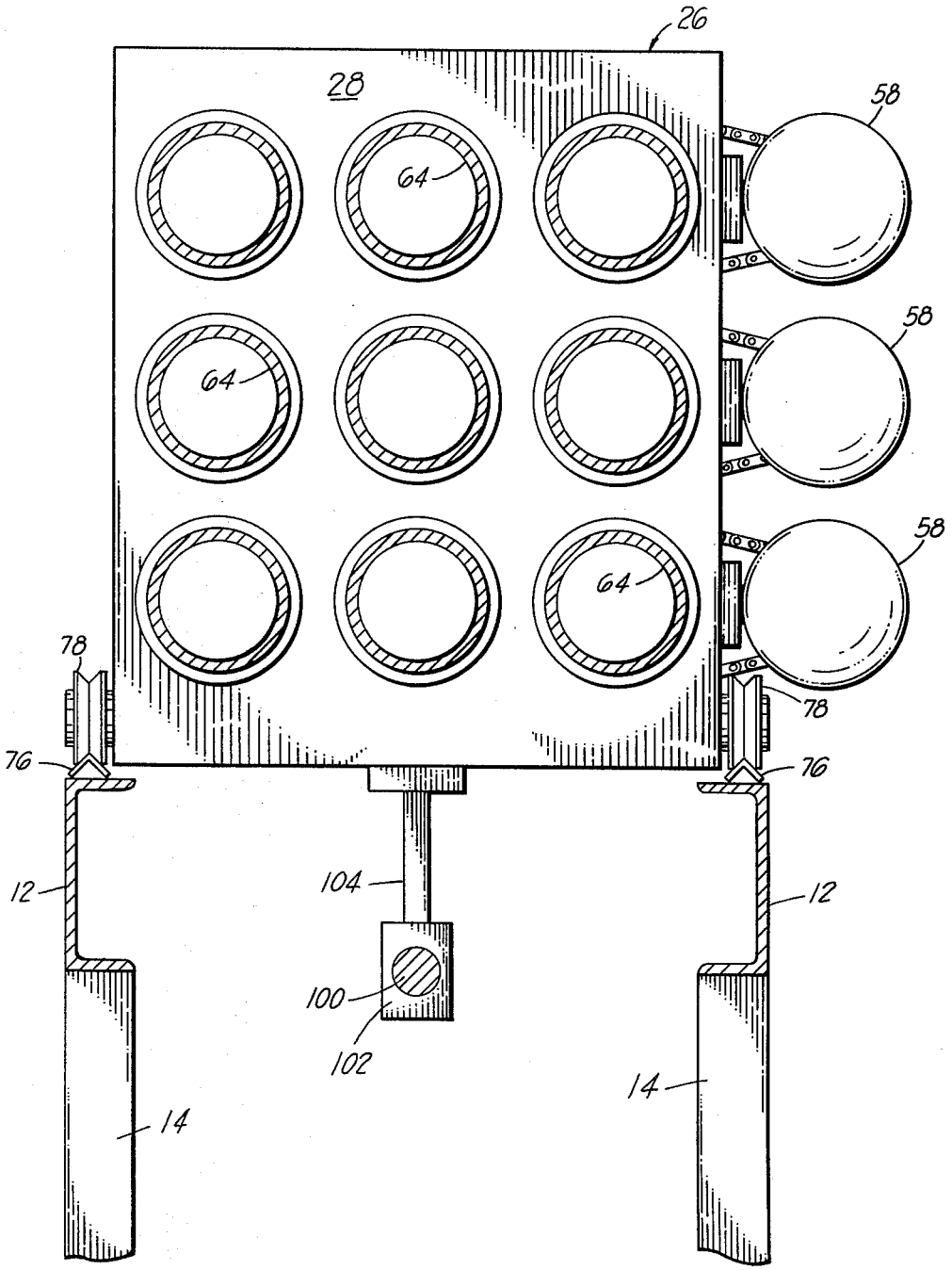
FIG. 20 is a sectional view taken on the line 20—20 of FIG. 19.

As seen in FIGS. 2 and 20, a track in the form of a pair of rails 76, which can be made from angle irons, is mounted on the upper flange of the channels 12, and the housing 28 is supported by four wheels 78, one at each corner, having V sections, adapted to ride on the angle irons.

Longitudinal movement of the carriage assembly 26 is produced by a reversible motor 80 (FIG. 2) supported by one of the legs 18, drivingly connected with a chain sprocket 82 also supported on the same leg. A drive chain 84 passes over the idler sprockets 86, 88, 90 and 92 carried by the frame structure, the opposite ends of the chain being attached to the right and left hand walls, respectively, of the carriage assembly 26. From the foregoing, it is evident that reverse rotation of the motor 80 is effective to cause movement of the carriage assembly in opposite directions along the track.

Figure 19:
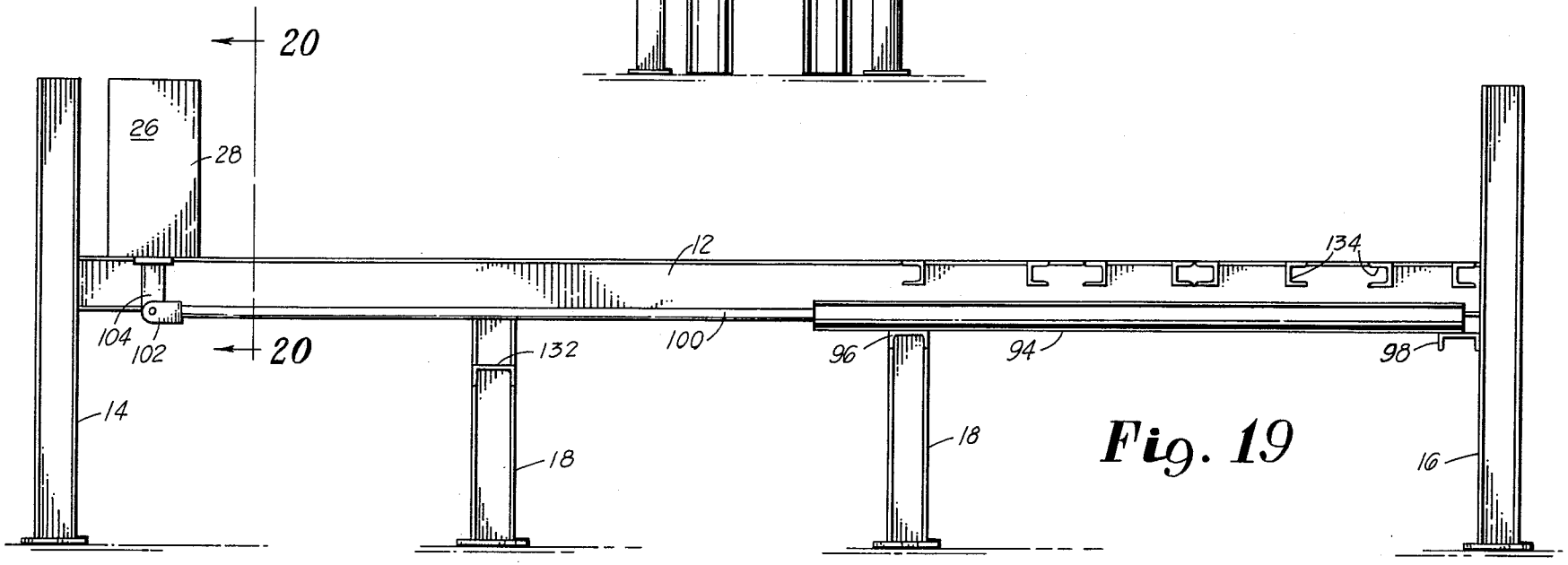
FIG. 19 is a skeleton side view showing an alternate form of carriage drive.

An alternative form of construction to cause movement of the carriage assembly is illustrated in FIGS. 19 and 20, comprising a reversible hydraulic jack 94 attached to the supporting members 96 and 98 extending between the right hand end posts 16 and a pair of intermediate legs 18, said members serving the double purpose of supporting the hydraulic jack and fuctioning as cross bracing.

A piston rod 100, attached at one end to the piston (not shown) in the cylinder of the jack 94, is attached at its outer and to a clevis 102 and a lug 104 welded to the bottom wall of the housing 28. Admission of pressure fluid to opposite ends of the hydraulic jack 94 causes reciprocation of the carriage assembly 26 along the rails 76 in an obvious manner.

Figure 11:
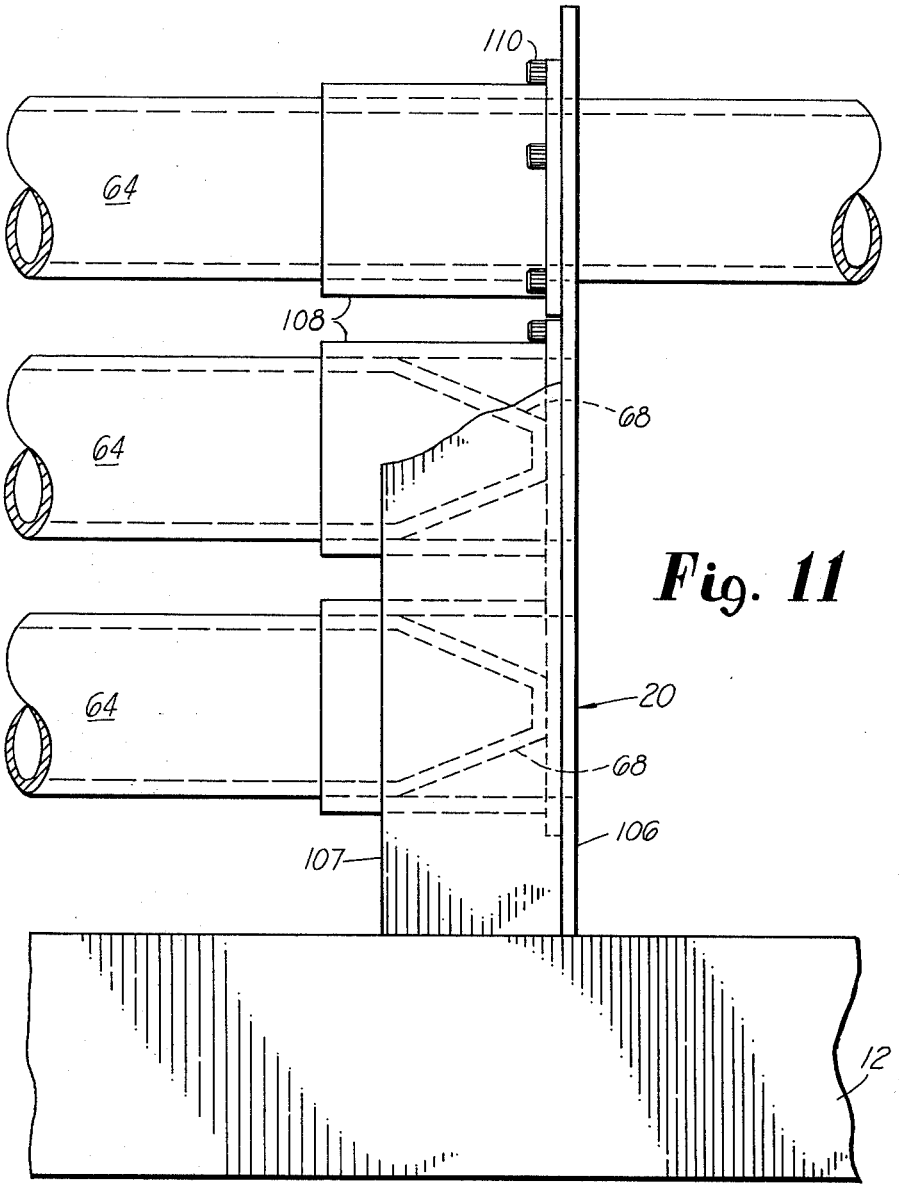
FIG. 11 is a side view of the bulkhead.
Figure 12:
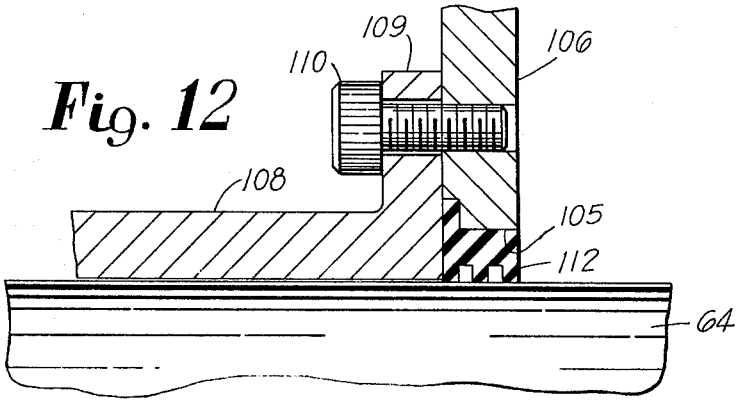
FIG. 12 is a sectional view showing a detail of the bulkhead.

The details of the bulkhead 20, illustrated in FIGS. 11 and 12, include a platen 106 having nine apertures 105 therethrough aligned with the apertures in the carriage assembly 26. The lower end of the platen is welded to a platen support in the form of a channel 107 which, in turn, is welded to the upper flanges of the channels 12.

A bearing sleeve 108, having an internal diameter equal to the external diameter of the mandrels 64 and adapted to receive the mandrel, is attached in alignment with each aperture 105 and secured to the platen by screws 110 passing through an aperture in a flange 109 and through an aperture in a flange 109 and through a threaded aperture in the platen. The apertures 105 in the platen are of greater diameter than the internal diameter of the sleeves, being rabbeted as shown in FIG. 12, to receive and retain a wiper 112 in contact with the mandrels passing therethrough.

Figure 5:
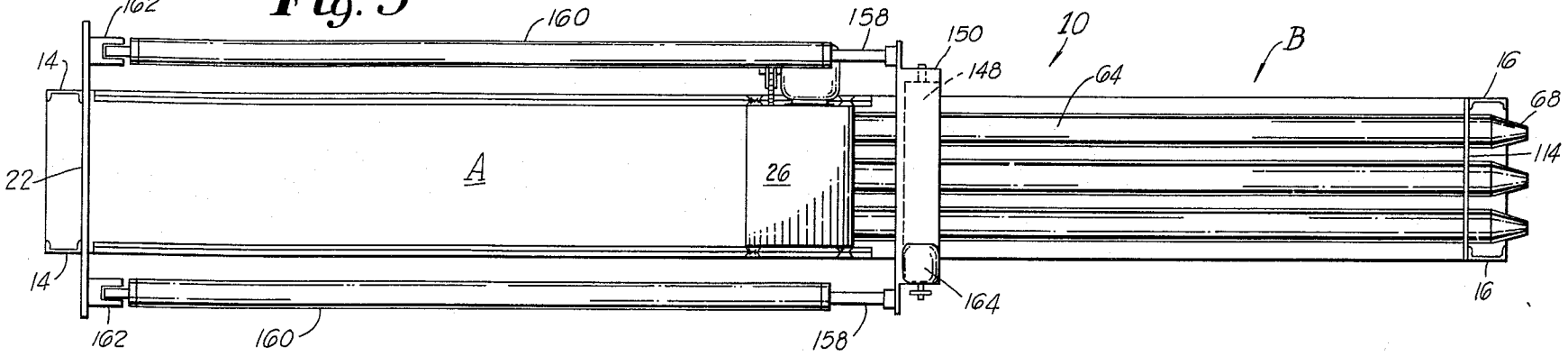
FIG. 5 is a skeleton drawing similar to FIG. 1 illustrating details of the screed assembly which are omitted from FIG. 1.
Figure 6:
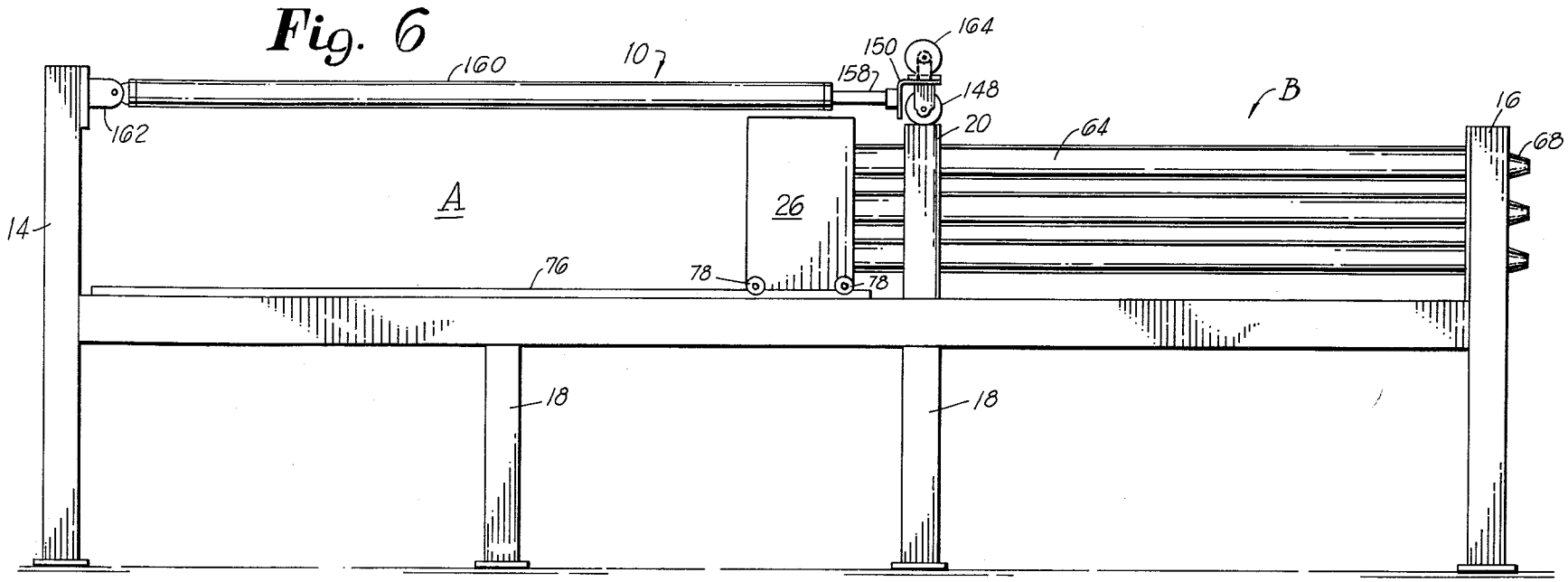
FIG. 6 is a skeleton drawing similar to FIG. 2 illustrating details of the screed assembly which are omitted from FIG. 2.

As shown in FIG. 16, an end plate 114 is secured to the right hand end legs 18, there being nine apertures 115 through the plate aligned with the apertures in the bulkhead platen 106, and adapted to receive the right hand ends of the mandrels 64 when the carriage assembly 26 occupies the position shown in FIGS. 5 and 6.

Figure 17:
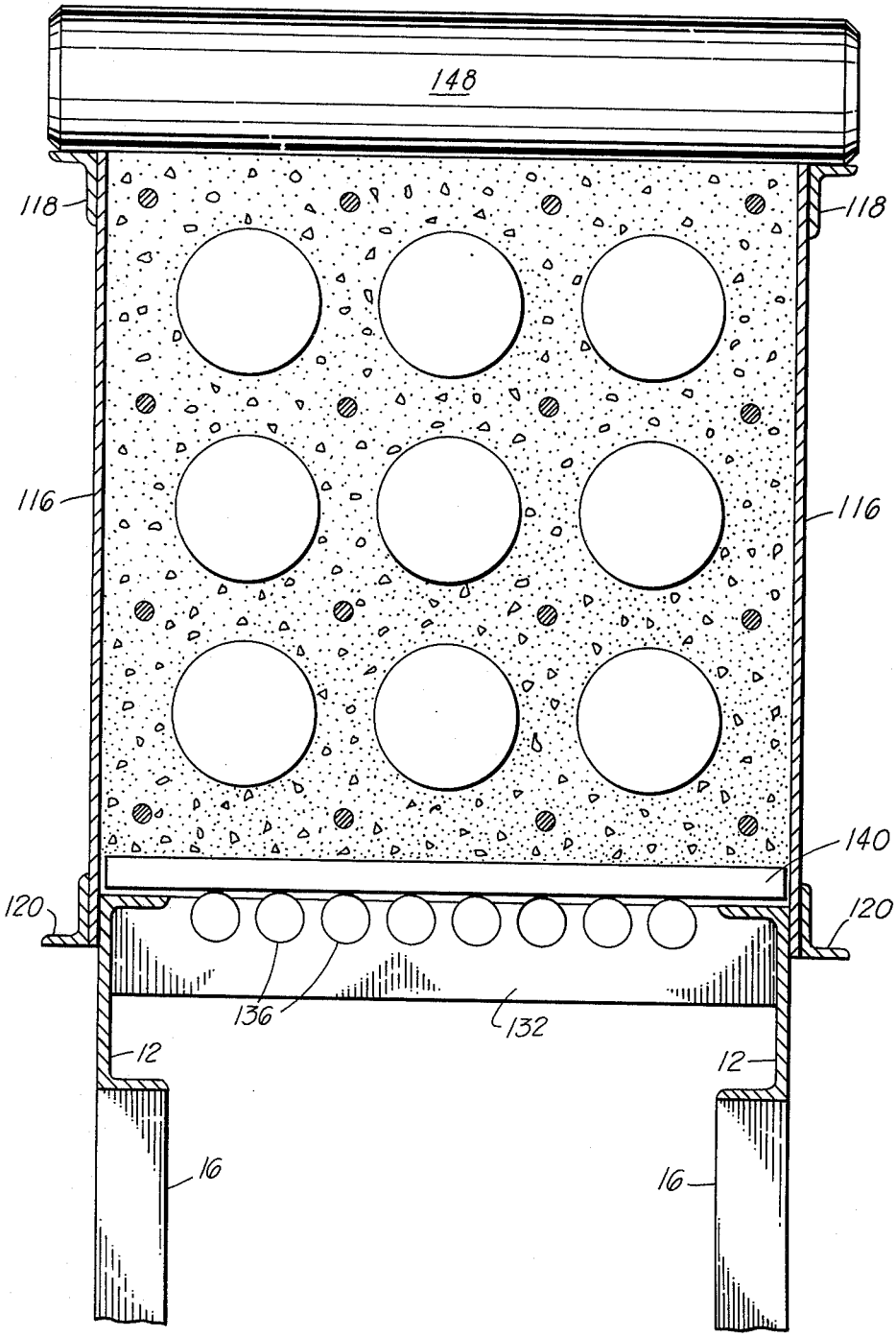
FIG. 17 is a sectional view through the mold receiving section as seen on the line 17—17 of FIG. 1.

The mold receiving section B, shown in FIGS. 13, 14, 15, 16, 17 and 18, includes a pair of vertically sliding doors 116, each door having welded thereto an angle 118 at its upper end, serving as a reinforcing member and as a guide for a screed roller to be described later in this description, and having a lower angle 120 functioning as a reinforcing member. Vertically extending guides 122, mounted on the end posts 16 and on the intermediate posts 18 and bulkhead 20, on each end of the doors, guide the doors in their up and down movement. A door 116 is mounted on each side of the mold receiving section as shown in FIG. 17.

A pair of hydraulic jacks 124, one connected at each end of a door 116, is attached to the upper end of the door by way of a piston rod 126, clevis 128, and an angle clip 130 (see FIGS. 14 and 16).

Transversely extending cross braces 132 are welded between the longitudinally extending channels 12 at spaced points for reinforcing purposes.

Figure 18:
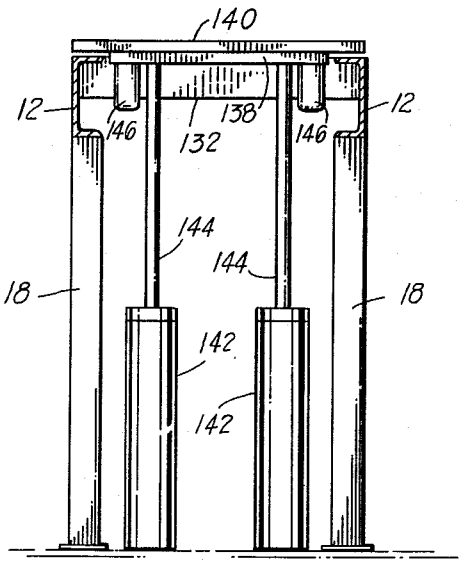
FIG. 18 is a sectional view through the lower part of the mold receiving section as seen on the line 18—18 of FIG. 2.

The floor of the mold receiving section B is formed by a plurality of transversely extending roller brackets 134 for supporting a plurality of rollers 136 (FIGS. 1, 17 and 19), there being a plurality of spaced sets of rollers adapted to move articles transversely of the molding machine as shown in FIG. 1. A pair of pallet lifting plates 138, extending transversely of the machine, each plate disposed between a pair of spaced sets of rollers 136, is adapted to support a mold receiving pallet 140 (FIG. 17). The plates 138 can be raised and lowered to preselected positions for the purpose of molding one, two or three tiered conduits by means of two pairs of hydraulic jacks 142 (FIGS. 2 and 18), there being a pair of jacks 142, each jack connected with one end of a plate 138, and all jacks are synchronized to move in the same direction at the same speed by means well known in the art and forming no part of this invention. Each jack 142 has a piston rod 144 attached to the lower surface of a plate 138. A pair of vibrators 146 is attached to the lower surface of each plate 138, as shown in FIG. 18.

The screed assembly, illustrated in FIGS. 5, 6, 8, 9 and 17, includes a screed roller 148 adapted to move across the upper surface of the article being molded after the concrete has been pured into the mold. A main bracket 150, extending transversely of the machine, carries on its lower surface a pair of pillow block supports 154 supporting a pair of pillow blocks 152 forming bearings for stub shafts 153 on the ends of the screed roller 148. A pair of lugs 156 extends from the ends of the main bracket 150, to which a pair of operating piston rods 158 is connected, the rods extending longitudinally of the machine and disposed in spaced relation at each side thereof, as shown in FIG. 5. The piston rods 158 are operated by a pair of hydraulic jacks 160, supported at one end of the end plate 22 by way of a pair of clevises 162.

A drive motor 164 is mounted on the upper surface of the main bracket 150. A sprocket 166 on the drive shaft of the motor 164 rotates the screed roller 148 through a drive chain 170 and a sprocket 168 on the stub shaft 153 of the screed roller.

OPERATION

In operation, if we assume that a nine duct conduit is to be molded, the piston rods 144 of the hydraulic jacks 142 are retracted to their lowermost positions, which places the pallet lifting plates 138 in a position just below the rollers 136. A pallet 140, supporting a nine duct mold, is brought into position on the rollers 136. All reinforcing rods and other reinforcing members would obviously be in position within the mold. The mold could be conveyed by rollers positioned on either side of the rollers 136. When the mold is positioned, the side doors 116 are raised by the hydraulic jacks 124 into the position shown in FIGS. 13, 14, 15 and 16.

The left hand ends of all nine mandrels 64 are secured to the sleeves 40 by the bolts and nuts 70 to be reciprocated and rotated with the corresponding movement of the sleeves. The carriage assembly 26 is advanced toward the right by actuation of the motor 80 in the form of the invention shown in FIG. 2, or by actuation of the jack 94 in the form of the invention shown in FIGS. 19 and 20, whereby the mandrels 64 pass through the bearing sleeves 108 (FIG. 11), through the mold, and extend through the openings 115 in the end plate 114 (FIG. 16).

Figure 10:
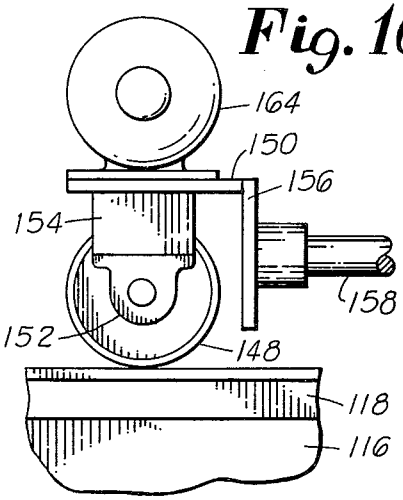
FIG. 10 is an end view of the screed assembly.

All of the three motors 58 are energized to rotate the mandrels 64, and concrete is poured into the mold from the upper open end, the vibrators 146 being energized during this operation to expel air pockets and to compact the concrete. The screed start drive motor 164 is energized to cause rotation of the screed roller 148, and the screed roller is advanced by admitting pressure fluid to the hydraulic jacks 160, causing the rotating screed roller to traverse the upper surface of the concrete within the mold to produce a smooth surface. The opposite ends of the screed roller contact the upper surface of the reinforcing angles 118 (FIG. 9) forming a guiding means for the screed roller. During this operation, the mandrels 64 are constantly rotating at a very low R.P.M. to provide a smooth inner surface for the ducts and to avoid adhesion of the concrete with the mandrels 64. When the formed conduit has assumed an initial set, sufficient to retain its form, the motor 80 (FIG. 2) or the hydraulic jack 94 (FIG. 10) is reversed, whereby the carriage assembly 26 is retracted to the position shown in FIG. 2, and the motors 58 are deenergized.

During the concrete setting period, the screed roller 148 can be continuously rotated andd reciprocated, being retracted and the motor 164 deenergized prior to the retraction of the carriage assembly 26. One or both doors 116 may then be lowered, by operation of their respective hydraulic jacks 124, to a position below the level of the upper surface of the rollers 136, permitting the removal of the pallet 140 and the filled mold thereon. The machine could then be reloaded with a new pallet carrying a conduit mold, and the cycle repeated.

If it were desired to produce a six duct conduit, a six duct mold would be placed on the rollers 136 and, by operation of the hydraulic jacks 142, the plates 138 would raise the pallet 140 to a position in which the mold would be in proper alignment with the upper six mandrels 64. Referring to FIG. 11, the bolts and nuts 70 retaining the lowermost row of mandrels 64 connected with the sleeves 40, would be removed, and these mandrels would be connected with the fixed sleeves 24 bt passing the bolts and nuts through openings in the fixed sleeves and the mandrels. This would prevent reciprocation of the lowermost row of mandrels with the movement of the carriage assembly 26 in an obvious manner.

Similarly, if it were desired to produce a three duct conduit, a three duct mold would be used, and the pallet 140 would be lifted to a position in which thee mold would be aligned with the upper row of mandrels. The two lowermost rows of mandrels 64 would then be disconnected from the sleeves 40 and bolted to the fixed sleeves 24 in the lowermost rows in the end plate 22.

It is evident that the machine could be used to form conduits having fewer than three ducts in each row merely by disconnecting one or more mandrels in any row from the rotating and reciprocating sleeves 40 and securing the ends of these mandrels to the fixed sleeves 24.

While the above description of the preferred embodiment refers to an arrangement having three tiers with three mandrels in each tier, it is evident that more or fewer than three tiers may be used, and that more or fewer than three mandrels in each tier or row may be used. It is also evident that the mandrels in each row may be offset with reference to those in the row above or below, or that different size mandrels may be used in different tiers or in the same tier.

I claim:

1. A conduit molding machine, comprising: an elongated supporting structure; a transversely extending bulkhead mounted on the upper part of the structure to form a mold receiving section and a mandrel operating section; said mandrel operating section including a travelling carriage having a plurality of mandrel driving sleeves disposed in parallel rows and in vertical tiers, said carriage including bearing means for rotatably supporting said sleeves; a mandrel disposed within each sleeve and mounted for rotative movement therein; a plurality of bearing sleeves carried by said bulkhead axially aligned with said sleeves in said carriage and adapted to receive said mandrels; a transversely extending plate fixed to said supporting structure adjacent said carriage, said plate including a plurality of openings therethrough aligned with said mandrels ian said carriage; means operatively associated with said carriage for reciprocating said carriage between said plate and said bulkhead whereby said mandrels traverse said mold receiving section; and means operatively associated with each mandrel for selectively connecting each mandrel to its surrounding driving sleeve or to an opening in said plate.

2. A conduit molding machine as defined in claim 1, in which said mold receiving section includes a plurality of spaced rollers extending axially of said structure adapted to receive and support a mold carrying pallet, at least one pallet receiving plate disposed between said rollers, and vibrating means attached to said pallet receiving plate.

3. A conduit molding machine as defined in claim 1, in which said mold receiving section is defined by said bulkhead, a pair of vertically movable side doors, and an end member, said end members having a plurality of openings therethrough disposed to receive the ends of said mandrels when the latter are extended; guide means supporting said doors for vertical movement, means operatively associated with said doors for raising and lowering said doors; screed roller operatively associated with said screed roller, means operatively associated with said supporting structure for reciprocsating said screed roller across the top of said mold receiving section, the upper edges of said doors including guide means for said screed roller.

4. A conduit molding machine as defined in claim 3, including means operatively associated with said screed roller for rotating said screed roller.

5. A conduit molding machine as defined in claim 1, including a sleeve in each of said openings in said plate and aligned therwith, said connecting means adapted to selectively connect a mandrel to its associated sleeve in said opening.

6. A conduit molding machine as defined in claim 1, in which said mold receiving section includes a plurality of spaced roller extending axially of said structure adapted to receive and support a mold carrying pallet, at least one mold carrying pallet receiving plate disposed between said rollers, and means operatively associated with said pallet receiving plate for raising and lowering said pallet receiving plate to selected levels, wereby, by disposing said pallet receiving plate at any selected level and by connecting mandrels in selected tiers to the surrounding sleeve or to the adjacent plate, conduits having a preselected number of ducts in each tier, and preselected tiers, may be molded.

7. A conduit molding machine, comprising: an elongated supported structure; a transversely extending bulkhead mounted on the upper part of said structure to form a mold receiving section and a mandrel operating section; said mandrel operating section including a travelling carriage having a plurality of sleeves disposed in parallel rows and vertical tiers, means carried by said carriage for rotating said sleeves; a mandrel disposed within each sleeve; a plurality of bearing sleeves carried by said bulkhead axially aligned with said sleeves in said carriage and adapted to receive said mandrels; a transversely extending plate fixed to said supporting structure adjacent said carriage; means operatively associated with said carriage for reciprocating said carriage between said plate and said bulkhead whereby said mandrels traverse said mold receiving section; and means operatively associated with each mandrel for selectively connecting each mandrel ot its surrounding sleeve or to said plate.

8. A conduit molding machine as defined in claim 7, in which said means rotating said sleeves includes power means mounted on and movable with said carriage.

9. A conduit molding machine as defined in claim 8, in which said power means includes a separate motor drivingly connected with the sleeves in each tier.

10. A conduit molding machine as defined in claim 9, in which said motors are attached to a side wall of said carriage.

* * * * *

UNITED STATES PATENT OFFICE

CERTIFICATE OF CORRECTION

Patent No. 4,043,723 Dated August 23, 1977

Inventor(s) Stewart E. Slaton

It is certified that error appears in the above-identified patent and that said Letters Patent are hereby corrected as shown below:

Column 1, line 25, the word "described" should appear as -- describes --.

Column 3, line 45, the word "and", second occurrence, should appear as -- an -- .

Column 4, line 33 should read -- and through an-- .

Column 5, line 20, the word "pured" should appear as -- poured -- ;

Line 67 should read -- pact the concrete. The screed drive motor 164 is -- .

Column 6, line 36, the word "bt" should appear as -- by --.

Column 7, line 12, the word "ian" should appear as --in--;

Line 30, the word "members" should appear as -- member --;

Lines 35-37 should read -- lowering said doors; a screed roller operatively associated with said supporting structure; means operatively associated with said screed roller for reciprocating -- .

Column 8, line 34, the word "ot" should appear as --to--.

Signed and Sealed this

Ninth Day of May 1978

[SEAL]

Attest:

RUTH C. MASON
Attesting Officer

LUTRELLE F. PARKER
Acting Commissioner of Patents and Trademarks